US005221948A

United States Patent [19]

Dalal

[11] Patent Number: 5,221,948

[45] Date of Patent: Jun. 22, 1993

[54] MULTIPLE RATE RAM SYSTEM

[75] Inventor: Edul N. Dalal, Webster, N.Y.

[73] Assignee: Xerox Corporation, Stamford, Conn.

[21] Appl. No.: 976,017

[22] Filed: Nov. 13, 1992

[51] Int. Cl.[5] ..... G03G 15/20

[52] U.S. Cl. ..... 355/284; 118/60

[58] Field of Search ..... 355/284; 118/60, 101, 118/255

[56] References Cited

U.S. PATENT DOCUMENTS

| | | | |
|---|---|---|---|
| 4,231,653 | 11/1980 | Nagahara et al. | 355/3 FU |
| 4,352,551 | 10/1982 | Iwao | 355/3 FU |
| 4,593,992 | 6/1986 | Yoshinaga et al. | 355/3 FU |
| 4,905,049 | 2/1990 | Bickerstaff et al. | 355/284 |
| 4,942,433 | 7/1990 | Stuart | 355/284 |
| 5,099,289 | 3/1992 | Kurotori et al. | 355/290 |

FOREIGN PATENT DOCUMENTS

| | | | |
|---|---|---|---|
| 155376 | 12/1980 | Japan . | |
| 132367 | 10/1981 | Japan . | |
| 35569 | 3/1983 | Japan . | |
| 47672 | 3/1987 | Japan . | |
| 164075 | 7/1987 | Japan . | |
| 107979 | 5/1991 | Japan . | |
| 3-158879 | 7/1991 | Japan | 355/284 |

*Primary Examiner*—Joan H. Pendegrass
*Attorney, Agent, or Firm*—Kevin R. Kepner

[57] ABSTRACT

A release agent management (RAM) system incorporated in an electrophotograpic printing machine having a heat and pressure fuser assembly to aid in the removal of fused copies from the fuser roll. The fuser assembly includes a heated fuser roll, a pressure roll, a sump containing a quantity of release agent, a pair of metering rolls and a donor roll. Each of the metering rolls is immersed in a quantity of release agent and is able to selectively be brought into contact with the donor roll. The donor roll acts as the transport to transfer release agent from either or both of the metering rolls to the heated fuser roll. The dual roll metering system provides a RAM system which can uniformly provide two or more oiling rates varying with the process speed of the printing machine. It also provides a RAM system which can switch oiling rates without creating oil slugs which ultimately reach the fuser thereby degrading copy quality.

12 Claims, 2 Drawing Sheets

MULTIPLE RATE RAM SYSTEM

Figure 1:
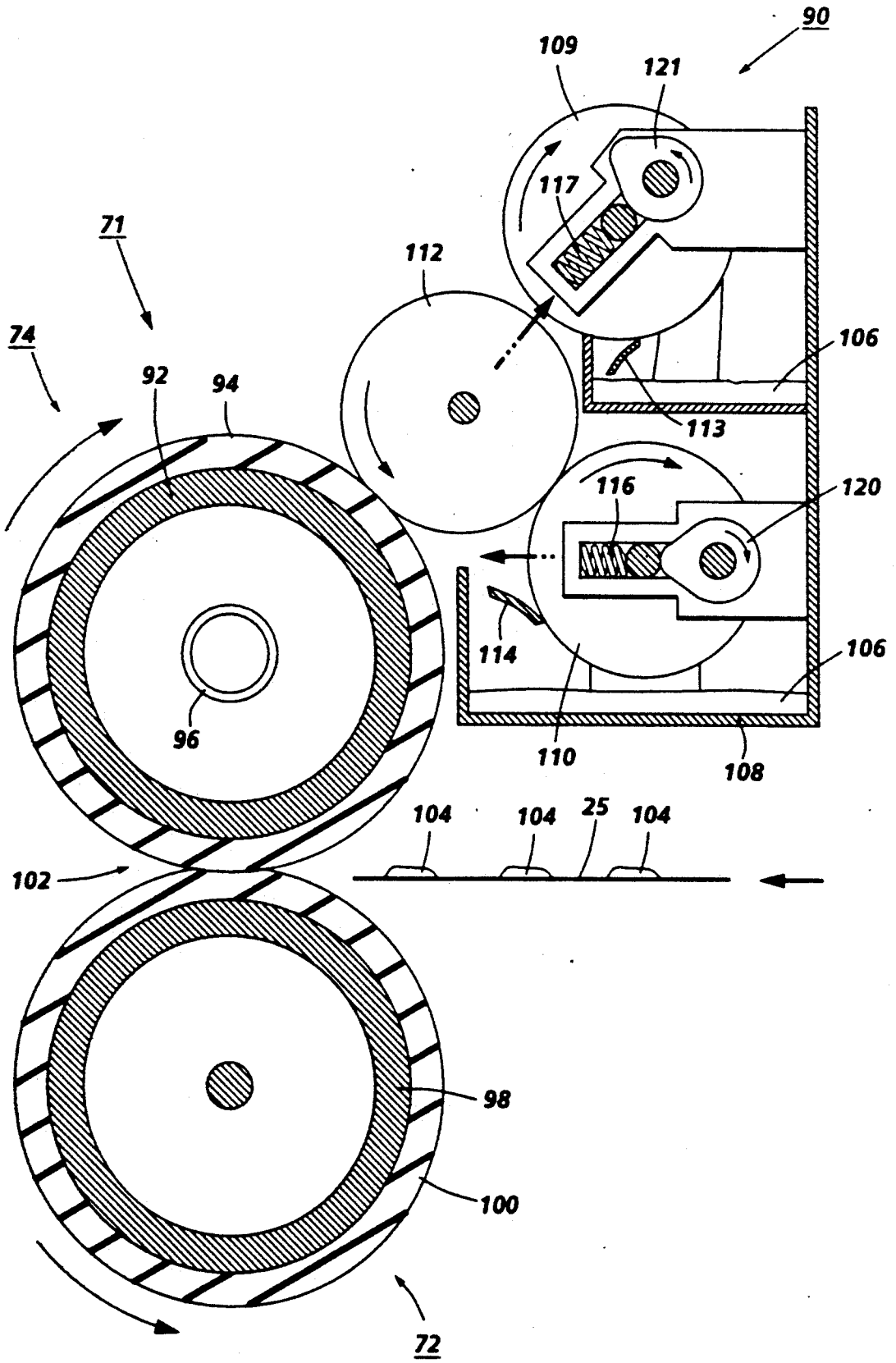

This invention relates generally to a fuser release agent distribution system for an electrophotographic printing machine, and more particularly concerns a system of plural metering rolls to provide varying predetermined amounts of release oil to the donor roll depending on the machine printing mode.

In a typical electrophotographic printing process, a photoconductive member is charged to a substantially uniform potential so as to sensitize the surface thereof. The charged portion of the photoconductive member is exposed to selectively dissipate the charges thereon in the irradiated areas. This records an electrostatic latent image on the photoconductive member. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

In order to fix or fuse the toner material onto a support member permanently by heat, it is necessary to elevate the temperature of the toner material to a point at which constituents of the toner material coalesce and become tacky. This action causes the toner to flow to some extent onto the fibers or pores of the support members or otherwise upon the surfaces thereof. Thereafter, as the toner material cools, solidification of the toner material occurs causing the toner material to be bonded firmly to the support member.

One approach to thermal fusing of toner material images onto the supporting substrate has been to pass the substrate with the unfused toner images thereon between a pair of opposed roller members at least one of which is internally heated. During operation of a fusing system of this type, the support member to which the toner images are electrostatically adhered is moved through the nip formed between the rolls with the toner image contacting the heated fuser roll to thereby effect heating of the toner images within the nip. Typical of such fusing devices are two roll systems wherein the fusing roll is coated with an adhesive material, such as a silicone rubber or other low surface energy elastomer or, for example, tetrafluoroethylene resin sold by E. I. DuPont De Nemours under the trademark Teflon. In these fusing systems, however, since the toner image is tackified by heat, it frequently happens that a part of the image carried on the supporting substrate will be retained by the heated fuser roller and not penetrate into the substrate surface. The tackified toner may stick to the surface of the fuser roll and offset to a subsequent sheet of support substrate or offset to the pressure roll when there is no sheet passing through a fuser nip resulting in contamination of the pressure roll with subsequent offset of toner from the pressure roll to the image substrate.

To obviate the foregoing toner offset problem, it has been common practice to utilize toner release agents such as silicone oil, in particular, polydimethyl silicone oil, which is applied to the fuser roll surface to a thickness of the order of about 1 micron to act as a toner release material. These materials possess a relatively low surface energy and have been found to be materials that are suitable for use in the heated fuser roll environment. In practice, a thin layer of silicone oil is applied to the surface of the heated roll to form an interface between the roll surface and the toner image carried on the support material. Thus, a low surface energy, easily parted layer is presented to the toners that pass through the fuser nip and thereby prevents toner from adhering to the fuser roll surface. Apparatus for applying the release agent material to a fuser member is commonly referred to as a release agent management (RAM) system.

In full process color printing machines, there are typically at least two process speed modes, a high speed mode for black or monochrome and a slow speed for full color. There may also be an even slower, third mode for printing items such as transparencies. As a result of these varying modes, it is necessary to provide different fuser oil rates for the different modes. In the slow speed modes the fuser requires a higher rate of oil to obtain optimum performance. Typically, however, RAM systems provide less oil at slower speeds.

It is desirable to provide a RAM system which can uniformly provide two or more oiling rates varying with the process speed of the printing machine. It is also desirable to provide a RAM system which can switch oiling rates without creating oil slugs which ultimately reach the fuser thereby degrading copy quality.

The following disclosures may be relevant to various aspects of the present invention:

U.S. Pat. No. 5,099,289
Patentee: Kurotori, et al
Issue Date: Mar. 24, 1992

U.S. Pat. No. 4,942,433
Patentee: Stuart
Issue Date: Jul. 17, 1990

U.S. Pat. No. 4,905,049
Patentee: Bickerstaff, et al.
Issue Date: Feb. 27, 1990

U.S. Pat. No. 4,593,992
Patentee: Yoshinaga, et ano.
Issue Date: Jun. 10, 1986

U.S. Pat. No. 4,352,551
Patentee: Iwao
Issue Date: Oct. 5, 1982

U.S. Pat. No. 4,231,653
Patentee: Nagahara, et ano.
Issue Date: Nov. 4, 1980

JP-A-164,075
Patentee: Aoki
Issue Date: Jul. 20, 1987

JP-A-476,672
Patentee: Tanabe
Issue Date: Mar. 2, 1987

JP-A-107,979
Patentee: Ishii
Issue Date: May 8, 1991

JP-A-155,376

Patentee: Yamashita
Issue Date: Dec. 3, 1980

JP-A-132,367
Patentee: Azuma
Issue Date: Oct. 16, 1981

JP-A-35,569
Patentee: Shigenobu
Issue Date: Mar. 2, 1983

U.S. Ser. No. 07/870,966
Inventor: Fromm, et al.
Filing Date: Apr. 20, 1992

The relevant portions of the foregoing disclosures may be briefly summarized as follows:

U.S. Pat. No. 5,099,289 discloses a fuser silicone oil dispenser which utilizes a metering member and a donor member and which is capable at operating in two modes to vary the amount of silicone oil delivered to the fuser.

U.S. Pat. No. 4,942,433 describes a release liquid applying device utilizing a rotating wick that is engaged by a fusing roller wherein the wick at times is prevented from rotating, thereby reducing the oil applied to the fuser roller.

U.S. Pat. No. 905,049 describes a fuser assembly utilizing a metering roll and donor roll to apply release oil to a fuser member wherein the sump or trough containing the fuser oil is integral with the exit guide of the fuser member.

U.S. Pat. No. 4,593,992 describes a device for intermittently applying the fuser release agent to the rotating fuser roll.

U.S. Pat. No. 4,352,551 discloses a fuser assembly having an oil impregnated felt applicator in contact with a donor roller in contact with a heated fuser roller wherein a rigid doctor blade is in contact with the heated fuser roller to distribute the oil applied to said fuser.

U.S. Pat. No. 4,231,653 describes a fuser assembly having a metering member, a donor member and a separate cleaner member in contact with the heated fuser member.

JP-A-164,085 describes a fuser assembly in which a solenoid actuated lever increases or decreases the amount of release agent applied to the fuser assembly by the donor member.

JP-A-476,672 describes a fuser member in which another solenoid actuated lever arm rotates to disconnect the donor member from the fuser oil supply to thereby reduce the amount of oil applied to the heated fuser member.

JP-A-107,979 describes a fuser assembly in which an adjusting blade is regulated as to its contact with a donor member to vary the amount of release oil applied to the heated fuser member.

JP-A-155,376 discloses a fuser assembly utilizing a donor member, which is contacted by a plurality of fixed liquid dispersal members to control the amount of oil applied to the donor member.

JP-A-132,367 describes a fuser assembly utilizing a donor roll and a metering roll, in which as the oil is increased in supply to the metering member, creates lesser friction between the metering member and the donor member, thereby reducing the amount of oil applied to the heated fuser roll.

JP-A-35,569 describes a heated fuser assembly in which the speed of the donor member is regulated to control the amount of oil supplied to the heated fuser roll.

U.S. Ser. No. 07/870,966 describes a release agent management system including a metering roll and a donor roll in which a metering blade structure for metering silicone oil onto the metering roll has two modes of operation. In one mode, a wiping action of the metering blade meters a relatively large quantity of silicone oil to the roll surface and in the other mode of operation, a doctoring action is affected for metering a relatively small amount of silicone oil to the roll surface.

In accordance with one aspect of the present invention, there is provided an apparatus for applying an offset preventing liquid to a fuser member. The apparatus comprises means for advancing offset preventing liquid to the fuser member and a plurality of independently movable members, said members being adapted to move from a position remote from said advancing means to a position adjacent thereto with each of said members being adapted to transport a quantity of offset preventing liquid so as to vary the quantity of offset preventing liquid being transported to said advancing means in response to the number of said members in the position adjacent said advancing means.

Pursuant to another aspect of the present invention, there is provided an electrophotographic printing machine in which an offset preventing liquid is applied to a fuser member. The improvement comprises means for advancing offset preventing liquid to the fuser member and a plurality of independently movable members, said members being adapted to move from a position remote from said advancing means to a position adjacent thereto with each of said members being adapted to transport a quantity of offset preventing liquid so as to vary the quantity of offset preventing liquid being transported to said advancing means in response to the number of said members in the position adjacent said advancing means.

Figure 2:
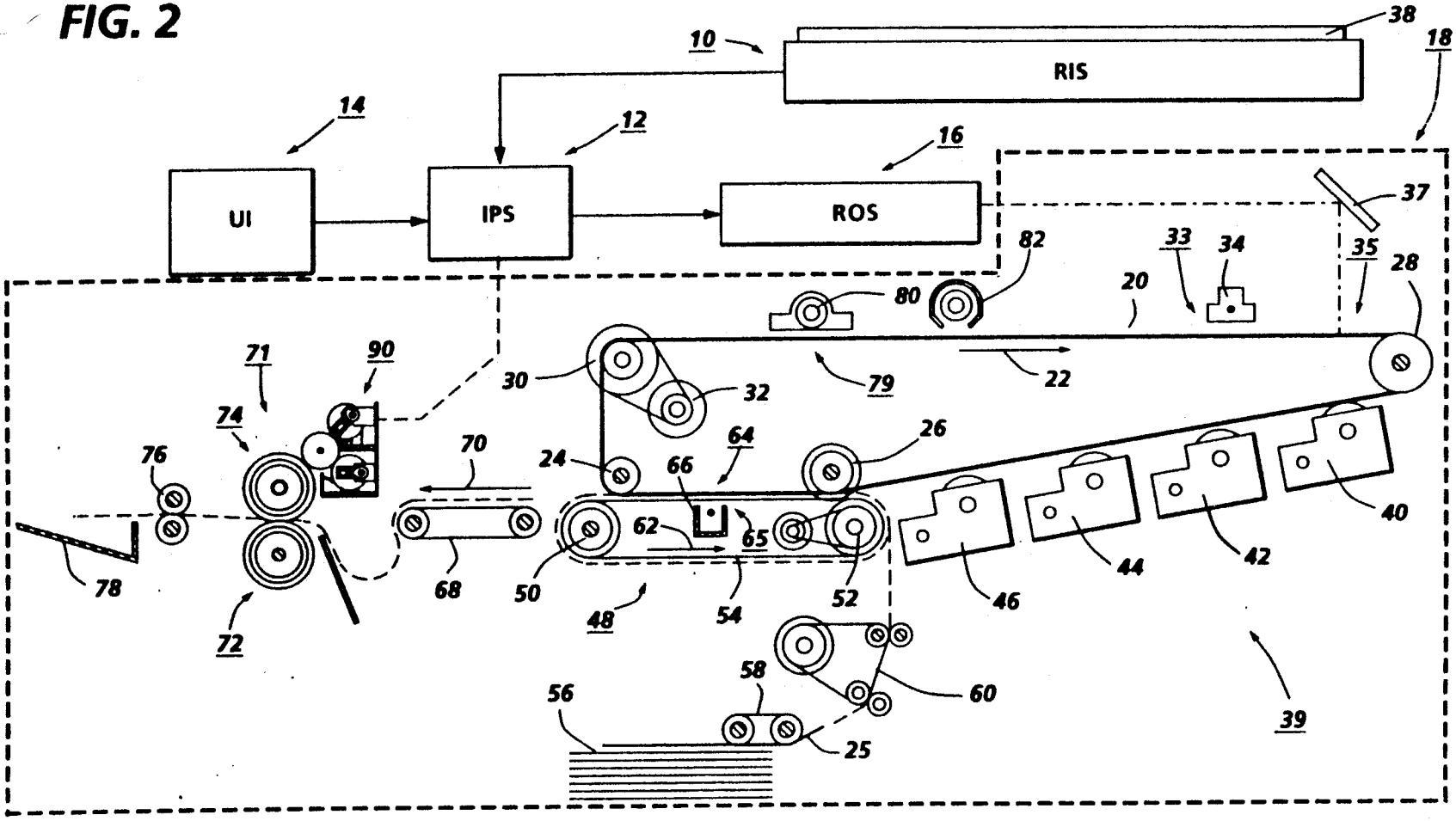

Other features of the present invention will become apparent as the following description proceeds and upon reference to the drawings, in which:

FIG. 1 is a side elevational view of a heat and pressure contact fuser incorporating the release agent management system of the present invention; and FIG. 2 is a schematic view of a full color electrophotographic printing machine incorporating the fuser assembly of FIG. 1.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

For a general understanding of the features of the present invention, reference is made to the drawings. In the drawings, like references have been used throughout to designate identical elements. FIG. 2 is a schematic elevational view of an illustrative electrophotographic machine incorporating the features of the present invention therein. It will become evident from the following discussion that the present invention is equally well suited for use in a wide variety of printing systems, and is not necessarily limited in its application to the particular system shown herein.

Turning initially to FIG. 2, during operation of the printing system, a multi-color original document 38 is positioned on a raster input scanner (RIS) indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith. ROS 16 exposes a charged photoconductive belt 20 of a printer or marking engine, indicated generally by the reference numeral 18, to achieve a set of subtractive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 2, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-colored original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired image to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12. A fourth latent image can also be recorded to be developed with black toner.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charge areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document and or to provide undercolor removal in a color image. Each of the developer units is moved into and out of an operative position. In the operative position, the magnetic brush is closely adjacent the photoconductive belt, while in the nonoperative position, the magnetic brush is spaced therefrom. In FIG. 2, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes, securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to change the sheet to the proper electrostatic voltage magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original documents is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Attention is now directed to FIG. 1, wherein the heat and pressure fuser apparatus comprising the fuser roll 74 and pressure roll 72 is illustrated together with a release agent management (RAM) system 90. As shown in FIG. 1, the fuser apparatus comprises the heated fuser roll 74 which is composed of a core 92 having thereon a layer or layers 94 of a suitable elastomer. The core 92 may be made of various metals such as iron, aluminum, nickel, stainless steel, etc., and various synthetic resins. Aluminum is preferred as the material for the core 92, although this is not critical. The core 92 is hollow and a heating element 96 is generally positioned inside the hollow core to supply the heat for the fusing operation. Heating elements suitable for this purpose are known in the prior art and may comprise a quartz heater made of a quartz envelope having a tungsten resistance heating element disposed internally thereof. The method of providing the necessary heat is not critical to the present invention, and the fuser member can be heated by internal means, external means or a combination of both. Heating means are well known in the art for providing sufficient heat to fuse the toner to the support. The fusing elastomer layer may be made of any of the well known materials such as Viton® and/or silicone rubber.

The fuser roll 74 is shown in a pressure contact arrangement with the backup or pressure roll 72. The pressure roll 72 comprises a metal core 98 with an outer layer 100 of a heat-resistant material. In this assembly, both the fuser roll 74 and the pressure roll 72 are mounted on bearings (not shown) which are biased so that the fuser roll 74 and pressure roll 72 are pressed against each other under sufficient pressure to form a nip 102. It is in this nip that the fusing or fixing action takes place. The layer 100 may be made of any of the well known materials such as Teflon, a trademark of E. I. duPont.

The image receiving member or final support 25 having toner images 104 thereon is moved through the nip 102 with the toner images contacting the heated fuser roll 74. The toner material forming the image 104 is prevented from offsetting to the surface of the fuser roll 74 through the application of a release agent material such as silicone oil 106 contained in a dual sump 108. Of course other configurations utilizing a single sump are also possible.

The dual sump 108 and silicone oil 106 form part of the RAM system 90. The RAM system 90, according to one embodiment of the invention, further comprises a pair of metering rolls 110, 109 and a donor roll 112. The metering rolls 109, 110 are supported partially immersed in the silicone oil 106 in each portion of the dual sump and may selectively be brought into contact with the donor roll 112 by camming devices 120, 121 for conveying varying quantities of silicone oil from the sump to the surface of the donor roll 112. The camming devices are automatically actuated by the IPS 12 depending on the copying mode selected. Springs 116, 117 bias the metering rolls against the cams 120, 121. In the illustration, roll 110 is shown in the operative position while roll 109 is non actuated. Obviously, the metering rolls may also be actuated by lever arms, spring mounted bearings or any other well known mechanical or electromechanical devices.

The donor roll is rotatably supported in contact with one of or both of the metering rolls and also in contact with the fuser roll 94. The metering rolls 109, 110 can each provide a different oiling rate to the donor roll by having different values of surface roughness and/or different surface coatings. The metering roll oil amount can also be altered by using different blade members or wipers or other known metering devices. This arrangement allows for three different predetermined amounts of oil to be provided to the fuser roll 74 by selecting either of the metering rolls 109, 110 individually or causing both of the rolls to contact the donor roll 112. While the donor roll 112 is illustrated as contacting the fuser roll 74, it will be appreciated that, alternately, it may contact the pressure roll 72. Also, the positions of the fuser and pressure rolls may be reversed for use in other copiers or printers.

Metering blades 113, 114 supported in contact with the metering rolls 109, 110 serve to meter silicone oil to the required thickness on each of the metering rolls. As the metering or doctor blades 113, 114 are always in contact with the corresponding metering roll, blade setup is not disturbed thereby delivering greater reliability. Also, since the blades 113, 114 do not part contact with the metering rolls, there is a lesser chance of an oil slug being allowed to form on the donor roll when the oil rates are switched.

In recapitulation, there is provided a pressure and heat toner fixing fuser having a release agent management system. A pair of metering rolls in contact with a supply of release agent such as silicone oil are selectively brought into contact with a donor roll. This system allows for three different fuser oiling rates depending on the operating mode of the printing machine. Additionally, as the metering blades are always in contact with the corresponding metering roll, reliability is enhanced and the chance of an oil slug being formed when oiling rates are changed is minimized.

It is, therefore, apparent that there has been provided in accordance with the present invention, a release agent management system that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for applying an offset preventing liquid to a fuser member comprising:

means for advancing offset preventing liquid to the fuser member; and a plurality of independently movable members, said members being adapted to move from a position remote from said advancing means to a position adjacent thereto with each of said members being adapted to transport a quantity of offset preventing liquid so as to vary the quantity of offset preventing liquid being transported to said advancing means in response to the number of said members in the position adjacent said advancing means.

2. An apparatus according to claim 1, wherein said advancing member comprises a roll in circumferential contact with said fuser member.

3. An apparatus according to claim 2, further comprising means for storing a supply of offset preventing liquid.

4. An apparatus according to claim 3, wherein said plurality of movable members comprise:

a plurality of metering rolls in contact with the offset preventing liquid in said storing means; and a plurality of blade members, one of said blade members being adapted to remove offset preventing liquid from one of said plurality of metering rolls so that each of said metering rolls applies a predetermined quantity of offset preventing liquid to said roll in the position adjacent thereto.

5. An apparatus according to claim 4, further comprising means for selectively moving each of said metering rolls to the position adjacent said donor roll.

6. An apparatus according to claim 5, wherein said means for moving comprises:

a cam member adapted to contact each of said metering rolls;

means for biasing each of said metering rolls against said cam members; and means for rotating said cam members so as to cause said metering rolls to move from a position remote from said advancing means to a position adjacent thereto.

7. An electrophotographic printing machine in which an offset preventing liquid is applied to a fuser member, wherein the improvement comprises:

means for advancing offset preventing liquid to the fuser member; and a plurality of independently movable members, said members being adapted to move from a position remote from said advancing means to a position adjacent thereto with each of said members being adapted to transport a quantity of offset preventing liquid so as to vary the quantity of offset preventing liquid being transported to said advancing means in response to the number of said members in the position adjacent said advancing means.

8. A printing machine according to claim 7, wherein said advancing member comprises a roll in circumferential contact with said fuser member.

9. A printing machine according to claim 8, further comprising means for storing a supply of offset preventing liquid.

10. A printing machine according to claim 9, wherein said plurality of movable members comprise:

a plurality of metering rolls in contact with the offset preventing liquid in said storing means; and a plurality of blade members, one of said blade members being adapted to remove offset preventing liquid from one of said plurality of metering rolls so that each of said metering rolls applies a predetermined quantity of offset preventing liquid to said roll in the position adjacent thereto.

11. A printing machine according to claim 10, further comprising means for selectively moving each of said metering rolls to the position adjacent said donor roll.

12. A printing machine according to claim 11, wherein said means for moving comprises:

a cam member adapted to contact each of said metering rolls;

means for biasing each of said metering rolls against said cam members; and means for rotating said cam members so as to cause said metering rolls to move from a position remote from said advancing means to a position adjacent thereto.

* * * * *